US006115871A

United States Patent [19]

Royer

[11] Patent Number: 6,115,871

[45] Date of Patent: Sep. 12, 2000

[54] TOOTHBRUSH STRUCTURE WITH MULTIPLE DIRECTIONAL BRISTLE PORTIONS

[76] Inventor: George R. Royer, 2137 Ragan Woods, Toledo, Ohio 43614

[21] Appl. No.: 09/072,579

[22] Filed: May 4, 1998

[51] Int. Cl.[7] ..... A46B 9/04

[52] U.S. Cl. ..... 15/167.2; 15/207.2; 15/167.1

[58] Field of Search ..... 15/167.1, 167.2, 15/207.2

[56] References Cited

U.S. PATENT DOCUMENTS

| | | | |
|---|---|---|---|
| 1,468,888 | 9/1923 | Stuart | 15/167.1 |
| 1,693,229 | 11/1928 | Felmar | 15/167.1 |
| 2,274,042 | 2/1942 | Cosby | 15/167.1 |
| 3,722,020 | 3/1973 | Hills | 15/167.1 |
| 4,051,571 | 10/1977 | Ayers | 15/167.1 |
| 4,081,876 | 4/1978 | Pugh | 15/167.1 |
| 4,852,202 | 8/1989 | Ledwitz | 15/167.1 |
| 5,331,704 | 7/1994 | Rosen et al. | 15/167.1 |
| 5,398,368 | 3/1995 | Elder | 15/167.1 |
| 5,742,972 | 4/1998 | Bredall et al. | 15/167.1 |
| 5,778,477 | 7/1998 | Conway | 15/167.1 |

FOREIGN PATENT DOCUMENTS

| | | | |
|---|---|---|---|
| 19408 | 7/1897 | United Kingdom | 15/167.1 |

*Primary Examiner*—Theresa T. Snider

[57] ABSTRACT

An improved toothbrush having a longitudinally extending base handle member with an upper surface and a lower surface and having opposing side surfaces, such base handle member having a longitudinal axis and a handle end and a brush end, with a first group of brush bristle members affixed to the brush end, which first group of brush bristle members extend outwardly from such brush end, with a separate and second group of said brush bristle members extending downwardly from the lower surface of the base handle member in a direction perpendicular to such lower surface and an additional group of brush bristles extending from a portion of base handle member in a direction different from the directional disposition of the first group.

4 Claims, 3 Drawing Sheets

TOOTHBRUSH STRUCTURE WITH MULTIPLE DIRECTIONAL BRISTLE PORTIONS

KNOWN PRIOR ART

Applicant is aware of various types of toothbrushes that have differing shapes of bristle members, that is, bristles with varying lengths extending from the shank of the toothbrush.

DISCUSSION OF PRIOR ART AND BACKGROUND OF THIS INVENTION

The subject invention pertains to the area of dental hygiene and implements that are used to maintain dental hygiene. Most particularly, the subject invention relates to dental hygiene devices such as toothbrushes used to clean teeth and adjacent gum areas.

Toothbrushes have been used for dental cleansing over several centuries and generally have comprised an elongated handle member with brush bristles extending out from a portion of the handle member, with such bristles being used to brush teeth for cleaning purposes. In the conventional toothbrush structure, a plurality of bristles are generally arranged in a mutually parallel manner and are affixed to the handle member to extend outwardly from an end portion of the handle member. In the most usual structural arrangement, these bristles extend outwardly to the same linear extent, creating a relatively flat outer brush surface at such bristle ends.

Other toothbrush structures have brush bristles of varying length, with varying bristle lengths disposed in groups over the array of bristles.

Other variant arrangements of toothbrush bristles exist in the prior art, some of which are commercially exploited.

However, none of the toothbrush structures in existing or previous arrangements are sufficiently structured as an aid in the brushing and cleansing of back surface areas those portions of the teeth that face towards the back of the mouth or interior surface areas of the teeth. Specifically, standard toothbrushes, with relative parallel brush bistles are relatively ineffective in reaching all the interior surface areas of the teeth.

As a consequence of the foregoing, the improved toothbrush as contemplated herein, is conceived to overcome these problems and provide a more efficient tooth cleaning device, and the following objects of the subject invention are conceived accordingly.

OBJECTS OF INVENTION

It is an object of the subject invention to provide an improved toothbrush structure;

Another object of the subject invention is to provide an improved toothbrush implement for properly cleaning all areas of the teeth;

A further object of the subject invention is to provide an improved toothbrush bristle arrangement for cleansing all surface areas of the teeth.

Still another object of the subject invention is to provide an improved toothbrush structure that has multi-directional brush bristles;

Yet another object of the subject invention is to provide an improved toothbrush bristle arrangement that provides full bristle contact with all surface areas of the teeth;

A further object is to provide a more effective toothbrush for cleansing the teeth and gums;

Other and further objects of the subject invention will be apparent from a reading of the description taken in conjunction with the claims.

DRAWINGS

DESCRIPTION OF PREFERRED EMBODIMENT OF INVENTION

In describing the preferred embodiment of the subject invention, a description of one or a few limited preferred embodiments shall not be construed to limit the scope of the invention herein as described in the written description and claims.

In setting forth only two preferred embodiments of the subject invention, the description of such preferred embodiments shall not limit the scope of the subject invention as set forth in this description.

Figure 4:
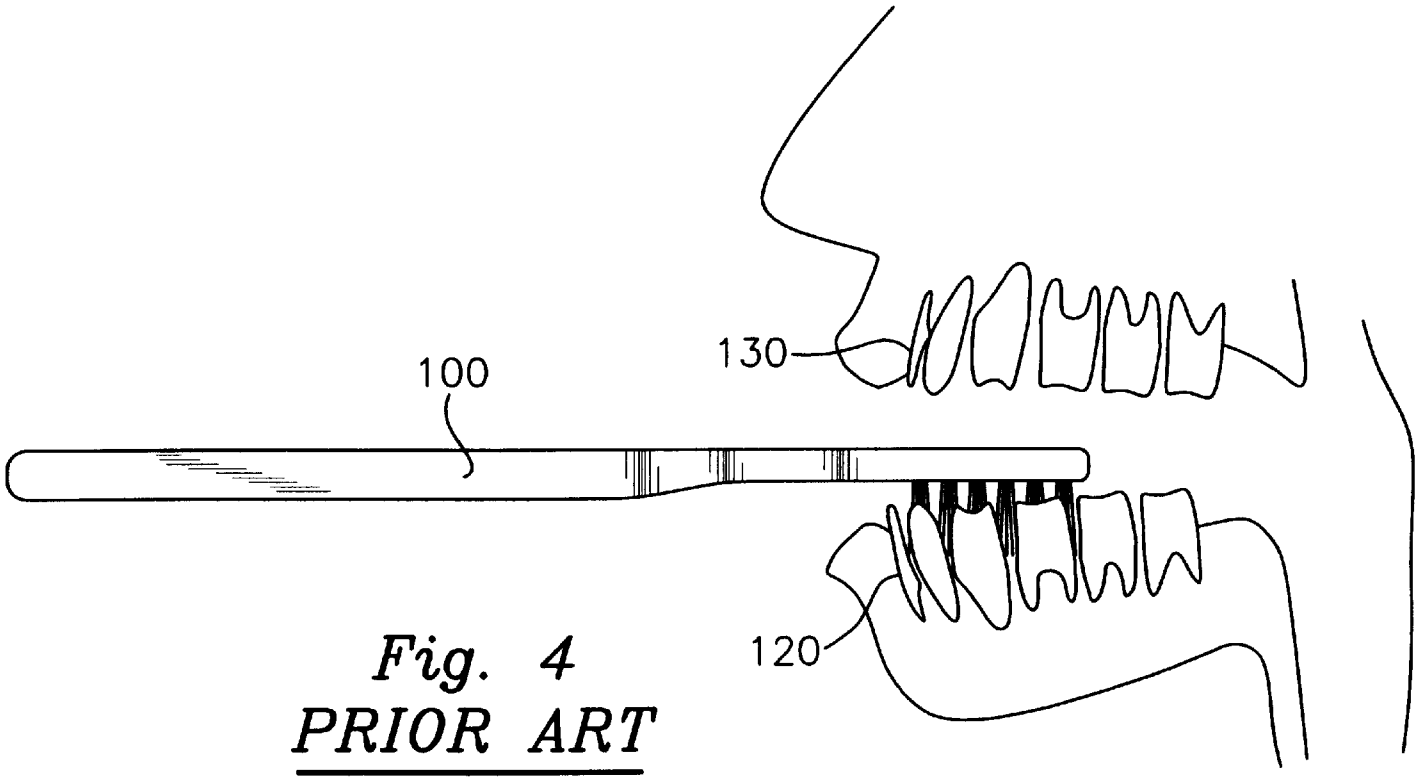
Fig. 4 PRIOR ART
FIG. 4 is a side elevational view of a conventional toothbrush structure shown in the human mouth demonstrating graphically the difficulty with having the ends of the brush bristles reaching the back surfaces of the front teeth.

As a general background, to demonstrate graphically, the problem with the overall effectiveness of existing toothbrushes, FIG. 4 shows schematically that existing toothbrush structures are inadequate to properly brush the back surface of the front teeth, as well as other interior surface areas of the teeth. The reason, as shown in FIG. 4, is that on a standard toothbrush 5, the brush bristles are aligned perpendicular to the longitudinal axis of the handle member 7, and by this arrangement, when the conventional toothbrush handle is inserted into the mouth, it is very difficult to align the ends of the brush bristles to face squarely against the back surface of the front teeth, in particular. Other inner areas of the teeth are difficult to reach with the bristle ends of a conventional toothbrush and FIG. 4 graphically demonstrates this problem.

Figure 1:
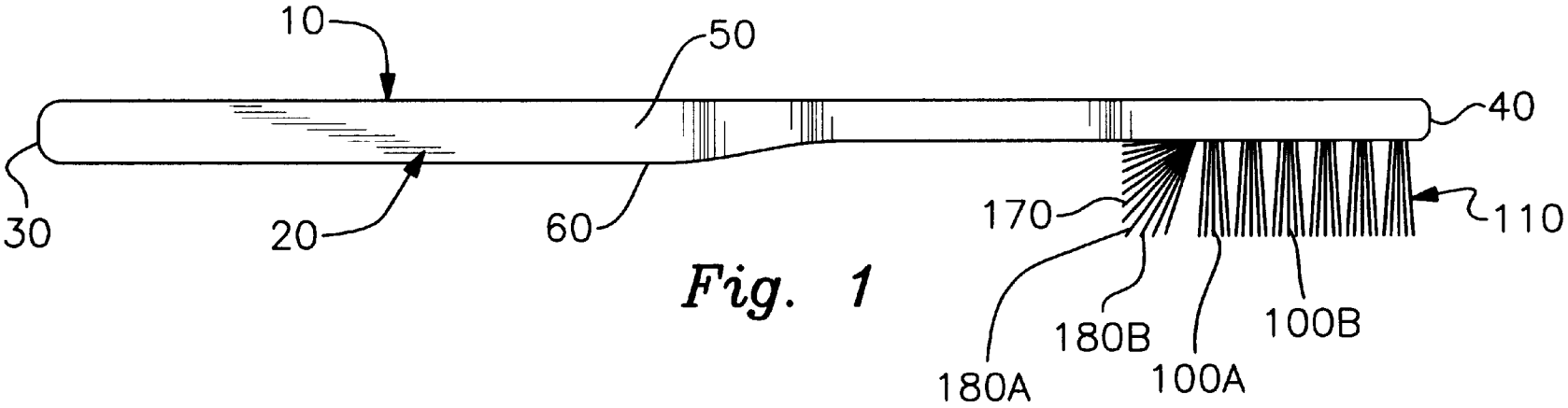
FIG. 1 is a side elevational view of the subject invention.
Figure 2:
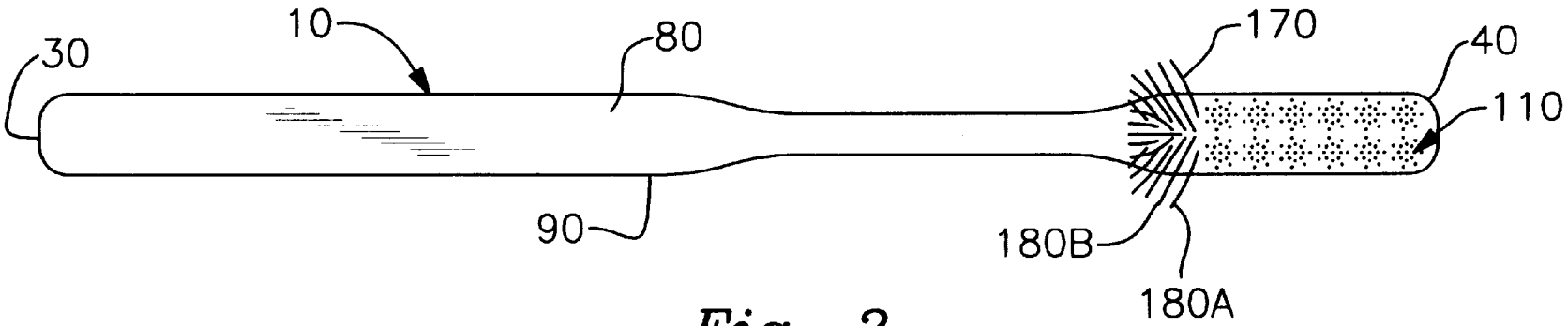
FIG. 2 is a bottom elevational view of the embodiment of the subject invention.
Figure 3:
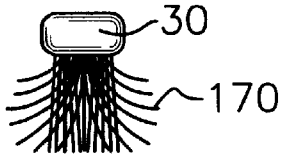
FIG. 3 is an end elevational view of the embodiment of the subject invention as shown in FIG. 1.

Referring to FIGS. 1 and 2 in which one preferred embodiment of the subject invention is shown, a toothbrush member 10 is shown as incorporating one embodiment having features of the subject invention. Toothbrush 10 is shown as having a longitudinally extending handle member 20, which handle member is generally of conventional construction. Toothbrush handle member 20 has a first end 30 and a second end 40. The first end 30 is considered the handle end for manually grasping to manipulate the toothbrush 10, while the second end 40 is considered to be the brush end, that is, the end that holds the toothbrush bristles, as more fully discussed below.

As can be seen from FIGS. 1 and 2 the longitudinally extending handle member 20 of toothbrush 10 has a relatively flat upper surface 50 and a relatively flat lower surface 60. Such upper surface 50 and lower surface 60 extend the entire length of the handle member 20 and are generally and preferably parallel to one another, as seen, although this latter feature is not critical. Moreover, handle member 20 has a first side surface 80 and a second side surface 90. As seen in both FIGS. 1 and 2, the toothbrush handle member 20 may vary in width at various portions along its length.

In the embodiment of the subject invention shown in FIGS. 1 and 2, affixed into lower surface 60 of the handle member 20 at or near the handle member's second end 40, are a plurality of bristle members 100A, 100B . . . that form a first brush portion 110 of the toothbrush 10. In this first embodiment, as shown in FIGS. 1 and 2, the bristles 100A, 100B . . . that form the first brush portion 110 are aligned parallel to one another and all such bristles generally depend away from the lower surface 60 of the handle member 20 in a direction that is generally and preferably substantially perpendicular to the lower surface of the handle member 20, as shown. In this arrangement, all such bristle members forming the first brush portion 110 are aligned generally parallel to one another and in this arrangement of the first brush portion 110 form a toothbrush brush portion that has the general configuration of all the bristles affixed on a conventional toothbrush, as shown in FIG. 4.

Again referring to the conventional toothbrush structure as seen in FIG. 4, when such a conventional toothbrush is used with the conventional bristle arrangement, there is limited capability of the ends of the brush bristles to contact and clean the back surfaces of the front teeth. This aspect arises because the bristle ends cannot properly or fully contact the back surfaces of the front teeth or other inner surface areas of the teeth. This aspect arises by reason of the bristle alignment being perpendicular to the handle member, and the resultant aspect that the brush bristles are substantially vertically aligned when the brush handle is placed in the mouth in a longitudinal direction. Moreover, it is difficult to maneuver the brush handle so that the bristle ends become aligned in a perpendicular direction to the back surface areas of the front upper and lower teeth. In order to accomplish this would require that the toothbrush handle be placed substantially in a vertically aligned position relative to the front teeth. In this contorted toothbrush position, the toothbrush is virtually useless for effective brushing. As a consequence of this latter aspect, the subject invention is structured to incorporate a second toothbrush portion 170 on the toothbrush handle 20, in addition to the first toothbrush portion 110. Such second toothbrush bristle portion, as will be observed from the following discussion, is adapted and can be used to brush those tooth surface areas, particularly the rear surface areas of the forward teeth, that are hard to brush with direct contact with the ends of the brush bristles of the first toothbrush bristle portion 110.

In particular, in addition to the first toothbrush bristle portion 110, a second toothbrush portion 170, as stated above, is affixed to the handle member 20, such second toothbrush bristle portion supplementing and complementing the first brush portion 110. More specifically, attention is directed to FIGS. 1 and 2 of the drawings in which the second brush portion 170 is shown as being affixed to the lower surface 60 of the toothbrush handle 20 preferably being placed in a position just adjacent to the first brush portion 110. As seen in the embodiment shown, the second brush portion 160 is affixed in a position that is adjacent that portion of the front brush portion 110 that is closest to the handle end 30 of the toothbrush handle 20. More simply expressed, if the second end 40 of the toothbrush handle 10 is called the front end of the brush, the second brush portion 170 is preferably affixed to the posterior portion of the first brush portion 110, as seen in FIGS. 1 and 2.

The toothbrush bristles form the second brush portion 170 of toothbrush 10 and comprise of individual bristle members 180A, 180B . . . which are aligned in a general direction that is directed somewhat relative to the lower surface 60 of handle member 20. More particularly, the bristles 180A, 180B . . . are directed generally towards the first end 30 of the brush handle 20 and by such arrangement the bristles 180A, 180B . . . can be positioned to contact the rear surface portions of the front teeth when the second brush portion 170 is placed just rearwardly of the rear surface of the front teeth and maneuvered around for brushing purposes.

As can be seen from the drawings and as discussed above, the bristle members 180A, 180B . . . forming the the second brush portion 170 are affixed to the lower surface of the handle member 20 with the bristles being affixed to such lower surface so that the bristles are directed at an inclined angle directed towards the first end 30 of the brush handle 20.

As seen, the secondary bristle members 180A, 180B . . . of the second brush portion 170 are imbedded in the handle member 20 so that a substantial portion of each bristle end 180A, 180B . . . are directed generally in an angular direction, as well as a downward direction, but also same are directed straight forward towards the first end 30 of the handle member 20. Thus, as seen in the embodiment shown in FIG. 1, the secondary bristles 180A, 180B . . . are inclined at various angles relative to the lower surface 60 of the handle member 20. This directional arrangement is not critical to the subject invention so long as some of the bristles 180A, 180B . . . forming the second brush portion 170 are directed generally towards the first end of handle 20 somewhat perpendicular to the lower surface 60 of the handle member.

Figure 5:
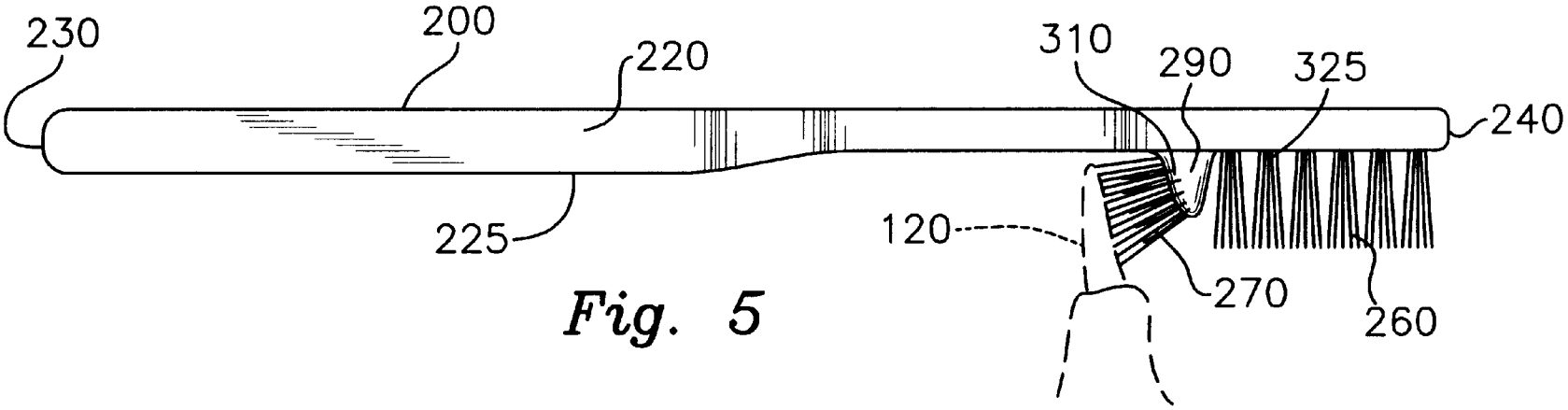
FIG. 5 is a side elevational view of yet another embodiment of the subject invention.
Figure 6:
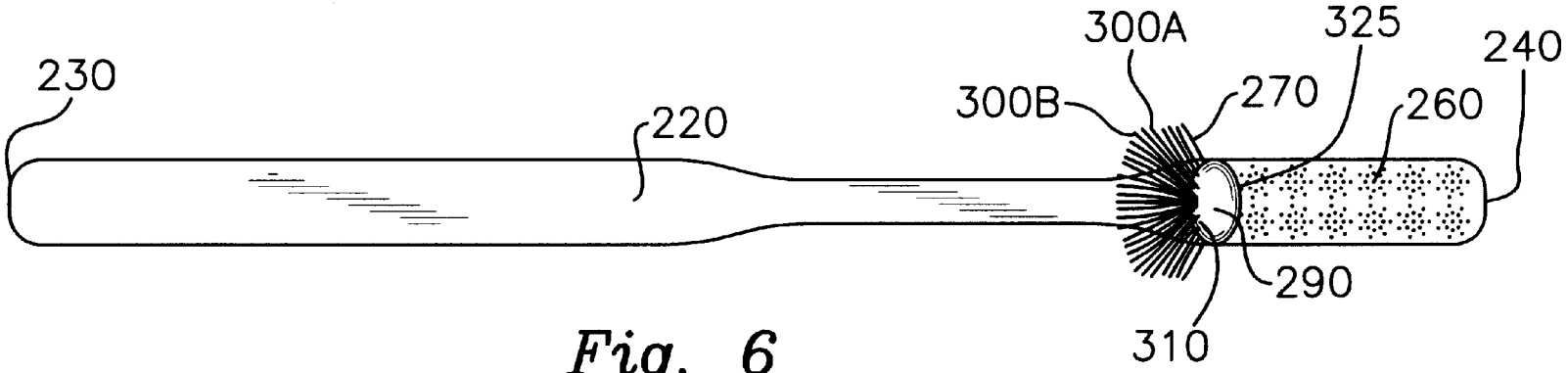
FIG. 6 is a bottom elevational view of the embodiment of the subject invention shown in FIG. 5.

Attention is directed to the second embodiment shown in FIGS. 5 and 6 of the drawings. In this embodiment, a toothbrush 200 is shown having a handle member 220 with a lower surface 225, with a first brush portion 260 and a second brush portion 270. This embodiment is substantially identical to the first embodiment as shown in FIGS. 1 and 2, except that the handle member 220 has a knob-like extension 290 on its lower surface 225, such knob-like member being integrally formed or attached on the handle member as a downwardly extending member, as seen. This knob-like extension 290 functions to hold secondary bristle members in place. More particularly, the secondary bristle members 300A, 300B . . . forming the second brush portion 270 in this second embodiment are affixed to the front surface 310 of the knob-like extension 290 that faces towards the handle end 230 of the toothbrush handle 220. As generally seen in the second embodiment the secondary bristles 300A, 300B . . . are affixed to project generally towards the first end 230 of the handle 220 as in the case with the first embodiment described. Variously stated, in the alternative embodiment shown in FIGS. 5 and 6, a knob-like extension or protrusion 290 is formed on a portion of the handle member 220 of toothbrush 200. This knob-like extension 290 can be formed on any portion of the toothbrush handle, however, a preferred location will be discussed below in conjunction with its intended function.

Attention is addressed again to FIGS. 5 and 6 of the preferred structural arrangement of this second embodiment, a first bristle portion 260 is affixed to the brush end 240 of the toothbrush handle member 220. This first brush portion 260 functions as the primary bristle members that are structured as conventional toothbrush bristle members which are disposed and directionally projected as on a conventional toothbrush. More particularly, the first brush portion 260 generally comprises bristles that extend outwardly from the toothbrush handle, usually from the lower surface 225, in a perpendicular direction relative to the surface of the toothbrush handle 220 from which the bristles of the first brush portion emanate, as seen. FIG. 5 shows the conventional positional arrangement as to such primary brush bristles forming the first brush portion 260 of the toothbrush 200. Also, in the preferred embodiment shown is the knob-like extension 290 that is formed from and as part of the toothbrush handle 220. The knob-like extension member 290 is preferably formed as an extension of the toothbrush handle at a portion of the toothbrush handle that is adjacent to the portion of the toothbrush handle from which the bristles forming the first brush portion 260 emanate, and more particularly on the portion of the toothbrush handle that is on the end of the first brush portion 260 that is nearest to the handle or first end 230 of the brush handle 220. This location is not critical, however.

As further seen in FIGS. 5 and 6, the protruding member 290 has a first surface 310 and a second side surface 325, which surfaces face respectively to the handle end or first end 230 and second end or brush end 240 of the toothbrush handle 220. In the preferred structure for this second alternate embodiment, a plurality of toothbrush bristle members 300A, 300B . . . are structured to emanate from the side surface 310 of the protruding member 290 with such bristle members structurally arranged to extend from the first surface 310 in multiple directions, somewhat parallel to the toothbrush handle 220 and projecting directionally towards the handle end and slightly downwardly away from the handle member 220 and away from the first brush portion 260, with some of the bristle members 300A, 300B . . . being directed away from the sides of the toothbrush bristles spreading out in a generally semi-circular manner. This latter embodiment is optional and the spread of the bristles 300A, 300B . . . forming the second brush portion 270, relative to the sides of the toothbrush member 200 may extend in various directions, parallel to the brush handle, as well as out to the sides of the brush handle in a semi-circular manner as seen from the lower elevational view of FIG. 6. With this arrangement the secondary bristles 300A, 300B . . . , form such secondary brush portion 270 and in such directional orientation can be used to brush the rear surface portions of the front teeth, with reference to the tooth outlined in FIG. 5. This secondary brush portion will be used to supplement the primary brush portion 270 in the overall brushing and cleaning of the teeth.

In summary, the subject invention is a toothbrush member comprising the following longitudinally extending handle member, such longitudinally extending handle member having a first end and a second end, with such longitudinally extending member having a first longitudinally extending surface and a second longitudinally extending surface, which second longitudinal extending surface opposes such first longitudinally extending surface, such longitudinally extending handle member having a protruding member formed on a portion of the second longitudinally extending surface, such protruding member extending away from such second longitudinally extending surface of such handle member having a plurality of primary bristle members affixed to such longitudinally extending surface, and comprising further a plurality of secondary toothbrush bristle members affixed to a portion of such protruding member on such handle member wherein such secondary toothbrush bristles are projected in a direction different than the direction of projection of the primary bristle members.

In yet further summary, the subject invention is a toothbrush member having a handle member, such handle member having an upper surface and a lower surface, with such handle member having a first end and a second end, with such handle member having a first bristle portion on the lower surface of such handle member, such first bristle portion comprising multiple bristles disposed in a perpendicular direction relative to the lower surface of the handle member, and such handle member having a second bristle portion, such second bristle portions extending from the lower surface of the handle member with such second bristles directed towards the first end of the handle member.

In still further summary, the subject invention is a toothbrush member comprising a longitudinally extending handle member, such longitudinally extending handle member having a first and a second end, with such longitudinally extending member having a plurality of longitudinally extending surfaces, such longitudinally extending handle member having a protruding member formed on a portion of one of the longitudinally extending surfaces of such handle member, such protruding member extending away from the longitudinally extending surface, to which such protruding member is affixed and a plurality of primary toothbrush bristle members affixed to a portion of one of such longitudinally extending surfaces of such handle member and a plurality of secondary bristle members affixed to such protruding member, such secondary bristle members projecting in a direction different than the direction of projection of the primary bristle member.

What is claimed is:

1. A toothbrush comprising:

a. a longitudinally extending handle member, said longitudinally extending handle member having a first and a second end, and a first longitudinally extending surface and a second longitudinally extending surface, wherein said second longitudinal extending surface opposes said first longitudinally extending surface, said longitudinally extending handle member further comprising a protruding member formed on the second end and on a portion of the second longitudinally extending surface, said protruding member extending away from said second longitudinally extending surface of said handle member, and said second longitudinally extending surface further having a plurality of primary bristle members affixed thereto at the second end;

b. a plurality of secondary bristle members affixed to a portion of said protruding member wherein said secondary bristle members are projected in a direction away from the direction of projection of the primary bristle members and towards the first end of said handle member.

2. A toothbrush member comprising a handle member, said handle member having an upper surface and a lower surface, wherein said handle member having a first end and a second end, wherein said handle member further comprising a first bristle portion on the lower surface of the second end of said handle member, said first bristle portion comprising multiple bristles disposed in a perpendicular direction relative to the lower surface of the handle member, and said handle member further comprising a second bristle portion located between said first end and said first bristle portion, said second bristle portion extending from the lower surface of the second end of the handle member with said second portion directed towards the first end of the handle member.

3. A toothbrush member comprising:

(a) a longitudinally extending handle member, said longitudinally extending handle member first and a second end, wherein said longitudinally extending handle member further comprising a plurality of longitudinally extending surfaces, said longitudinally extending handle member further comprising a protruding member formed on the second end and on a portion of one of the longitudinally extending surfaces of said handle member, said protruding member extending away from one of the said longitudinally extending surfaces, to which said protruding member is affixed;

(b) a plurality of primary toothbrush bristle members affixed to the second end and on said a portion of one of said longitudinally extending surfaces of said handle member;

(c) a plurality of secondary bristle members affixed to said protruding member, said secondary bristle members projecting in a direction away from the direction of projection of the primary bristle members and towards the first end of said handle member.

4. A toothbrush member comprising;

(a) a longitudinally extending handle member, said longitudinally extending handle member having a first and a second end, said handle member having a protruding member formed on a surface portion of said handle member, said protruding member extending away from said handle member;

(b) a plurality of primary toothbrush bristle members affixed to a surface portion of said handle member on the same surface as said protruding member;

(c) a plurality of secondary toothbrush bristle members affixed to said protruding member on said handle member, said secondary toothbrush bristle member being affixed to project in a direction that is away perpendicular to the direction of projection of the primary toothbrush bristle members and towards the first end of said handle member.

* * * * *